US008281711B2

(12) United States Patent
Haberstroh et al.

(10) Patent No.: US 8,281,711 B2
(45) Date of Patent: Oct. 9, 2012

(54) MODULAR FEED HEAD WITH REVERSING MOTOR

(75) Inventors: James A. Haberstroh, Vernon Hills, IL (US); Timothy B. Pearson, Antioch, IL (US); Jeffrey D. Termanas, Rolling Meadows, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/339,269

(22) Filed: Dec. 28, 2011

(65) Prior Publication Data

US 2012/0167532 A1 Jul. 5, 2012

Related U.S. Application Data

(60) Provisional application No. 61/429,583, filed on Jan. 4, 2011.

(51) Int. Cl.
*B65B 13/22* (2006.01)
*B65B 13/04* (2006.01)

(52) U.S. Cl. ..... 100/26; 100/29; 100/32; 53/589

(58) Field of Classification Search ..... 100/26, 100/29, 32; 53/589; 242/532.5, 596.4, 586.5
See application file for complete search history.

(56) References Cited

U.S. PATENT DOCUMENTS 4,516,488 A * 5/1985 Bartzick et al. ..... 100/4
5,459,977 A * 10/1995 Haberstroh ..... 53/399
6,334,563 B1 * 1/2002 Schwede ..... 226/35
6,505,766 B2 * 1/2003 Cheung et al. ..... 226/193
6,584,892 B2 7/2003 Flaum et al.
6,663,040 B2 * 12/2003 Haberstroh et al. ..... 242/532.5
6,755,123 B2 * 6/2004 Flaum et al. ..... 100/26
2003/0056337 A1 3/2003 Scholl et al.
2003/0221566 A1 12/2003 Apel et al.

OTHER PUBLICATIONS

International Search Report and the Written Opinion of the International Searching Authority issued in connection with PCT/US2011/067758 on May 7, 2012.

* cited by examiner

*Primary Examiner* — Jimmy T Nguyen
(74) *Attorney, Agent, or Firm* — Levenfield Pearlstein, LLC

(57) ABSTRACT

A feed head for a strapping machine includes a frame, a feed wheel, a tension wheel, and a feed and take-up motor mounted to the frame and operably connected to the feed wheel. The feed and take-up motor operates in forward and reverse directions to feed strapping material through the strapping machine, and to take up strapping material from the strapping machine. A tension motor is operably connected to the tension wheel and operates in a reverse direction to tension the strapping material around the load. The tension wheel is movable toward and away from the feed wheel and engages the feed wheel during strap tension and disengages from the feed wheel during strap feed. A pivot assembly operably mounts the tension motor and tension wheel to the frame to move the tension wheel toward and into engagement with, and out of engagement with the feed wheel.

16 Claims, 5 Drawing Sheets

MODULAR FEED HEAD WITH REVERSING MOTOR

CROSS-REFERENCE TO RELATED APPLICATION DATA

This application claims the benefit of priority of Provisional U.S. Patent Application Ser. No. 61/429,583, filed Jan. 4, 2011, the disclosure of which is incorporated herein by reference.

BACKGROUND

The present disclosure is directed to a feed head for strapping machines. More particularly, the present disclosure pertains to a modular feed head having a reversing motor.

Strapping machines are well known in the art for securing straps around loads. One type of known strapping machine includes a feed head having a feed and tension assembly mounted within the frame of the strapping machine. Also mounted to the frame is a sealing head and a strap chute through which strapping material is fed. The feed and take-up assembly feeds strap through the feed and sealing heads, and into and around the strap chute, until the strap material returns to the sealing head to form a loop around the load. The strap end is then gripped and the feed head pulls or "takes up" the strap snuggly against the load. The machine then enters a tension cycle during which tension and drive wheels are engaged and tension is applied to the strap to constrict the strap loop about the load. The overlapping strap courses are then secured to one another by, for example, heat sealing, welding or the like, at the sealing head, to create a sealed, tensioned loop around the load. The strap loop is then cut from the strap feed and the load is discharged from the machine.

The process of engaging the tension and drive wheels to grip the strap in order to constrict the strap around the load has heretofore been performed through the use of a motor, solenoid, air cylinder, hydraulic cylinder, or other like mechanism, separate from the tensioning mechanism and the feed and take-up mechanism, that is capable of moving the tension wheel into and out of the plane of the strap. Thus, in addition to the feed and take-up mechanism and the tension mechanism, there is an additional mechanism for moving the tension and drive wheels into and out of engagement with one another. These additional motors, solenoids, and the like, while effective, often add to the complexity, weight, and cost of the strapping machine, as well as increase the amount of downtime necessary for replacement or maintenance of the strapping machine.

Accordingly, it would be desirable to have an improved feed head that is less complicated and less costly than previously known. Such an improved feed head would be easy to install and use, and minimize the amount of downtime needed for equipment replacement or maintenance.

SUMMARY

A modular feed head is adapted for use with a strapping machine of the type for feeding a strapping material around a load, tensioning the strapping material, and sealing the strapping material around the load. The feed head includes a frame, a feed wheel, a tension wheel, a feed and take-up motor and a tension motor.

The feed and take-up motor is mounted to the frame and is operably connected to the feed wheel. The feed and take-up motor is configured to operate in a forward direction, driving the feed wheel to feed the strapping material through the strapping machine and, in a reverse direction to take up strapping material from the strapping machine.

The tension motor is operably connected to the tension wheel and is configured to operate in a reverse direction to tension the strapping material around the load. The tension wheel is movable toward and away from the feed wheel and is configured for engagement with the feed wheel during strap tension and disengagement from the feed wheel during strap feed.

A pivot assembly operably mounts the tension motor and tension wheel to the frame to move the tension wheel toward and into engagement with, and out of engagement with the feed wheel.

In an embodiment, the pivot assembly includes a carriage, and the tension motor and tension wheel are mounted to the carriage. The carriage can be biasedly mounted to the frame. In such an embodiment, a spring biasedly mounts the carriage to the frame. The spring biases the tension wheel toward the feed wheel.

A one-way bearing can be operably mounted to the tension motor and tension wheel. The one-way bearing drives rotation of the tension wheel in the reverse (or take-up) direction and permits free rotation of the tension wheel in the forward (or feed) direction.

To effect the pivoting movement, a cam having at least one lobe can be operably connected to the tension motor and a cam follower can be operably mounted to the frame. In such an embodiment, engagement of the cam lobe with the cam follower moves the tension wheel away from the feed wheel. Conversely, disengagement of the cam lobe with the cam follower allows the tension wheel to move into engagement with the feed wheel.

The tension wheel can include a friction enhanced surface thereon. The friction enhanced surface can be teeth formed on a surface of the tension wheel. A pinch wheel is disposed for engagement with the feed wheel.

A strapping machine with a modular strapping head with reversing motor is also disclosed. The strapping machine is of the type for feeding a strapping material around a load, tensioning the strapping material, and sealing the strapping material around the load. The strapping machine includes a machine frame, a strap chute, a sealing head and a feed head.

The feed head includes a frame, a feed wheel, a tension wheel, a feed and take-up motor and a tension motor. The feed and take-up motor is mounted to the frame and is operably connected to the feed wheel. The feed and take-up motor is configured to operate in a forward direction, driving the feed wheel to feed the strapping material through the strapping machine and, in a reverse direction to take up strapping material from the strapping machine.

The tension motor is operably connected to the tension wheel and is configured to operate in a reverse direction to tension the strapping material around the load. The tension wheel is movable toward and away from the feed wheel and is configured for engagement with the feed wheel during strap tension and disengagement from the feed wheel during strap feed.

A pivot assembly operably mounts the tension motor and tension wheel to the frame to move the tension wheel toward and into engagement with, and out of engagement with the feed wheel.

These and other features and advantages of the present invention will be apparent from the following detailed description, in conjunction with the appended claims.

DETAILED DESCRIPTION

Figure 1:
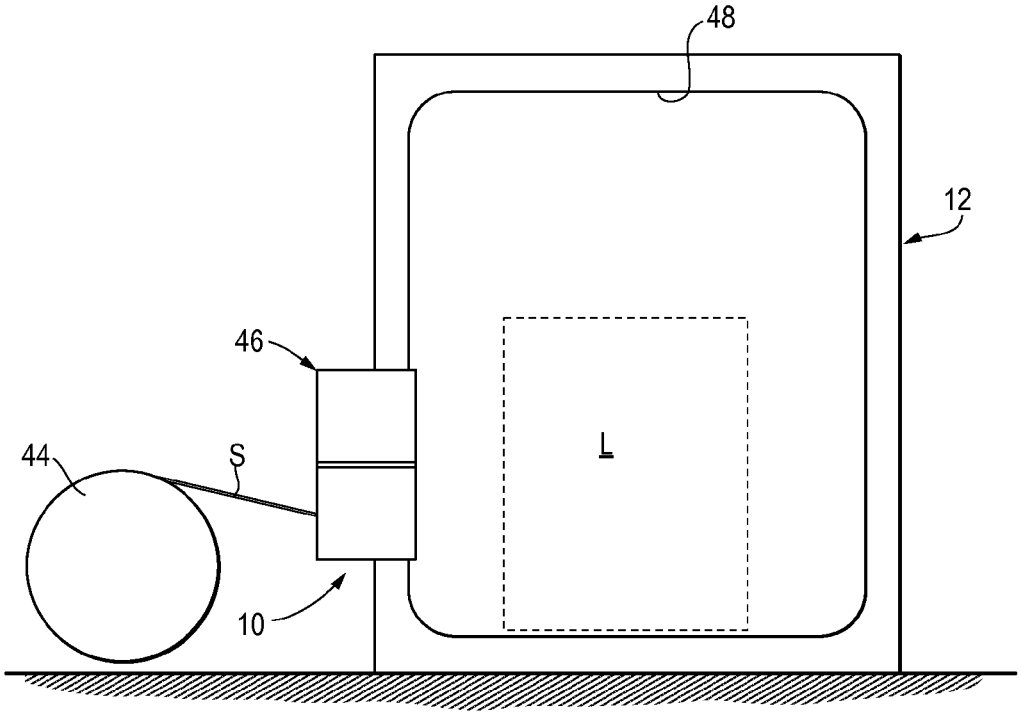
FIG. 1 is a schematic illustration of an exemplary strapping machine having a modular feed head with reversing motor in accordance with the principles of the present invention.

While the present disclosure is susceptible of embodiment in various forms, there is shown in the drawings and will hereinafter be described a presently preferred embodiment with the understanding that the present disclosure is to be considered an exemplification and is not intended to limit the present disclosure to the specific embodiment illustrated.

Figure 2:
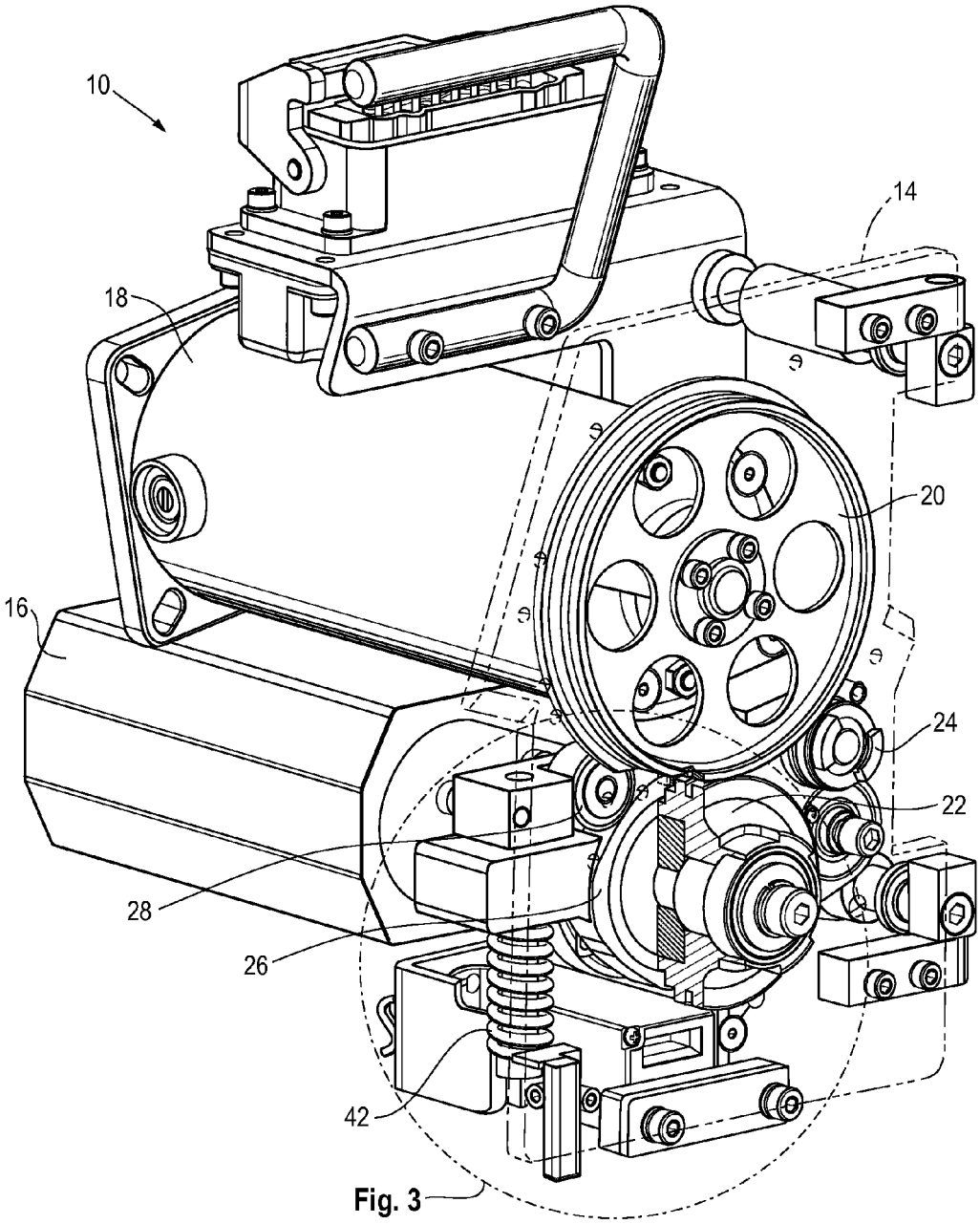
FIG. 2 is a perspective view of the feed head.
Figure 3:
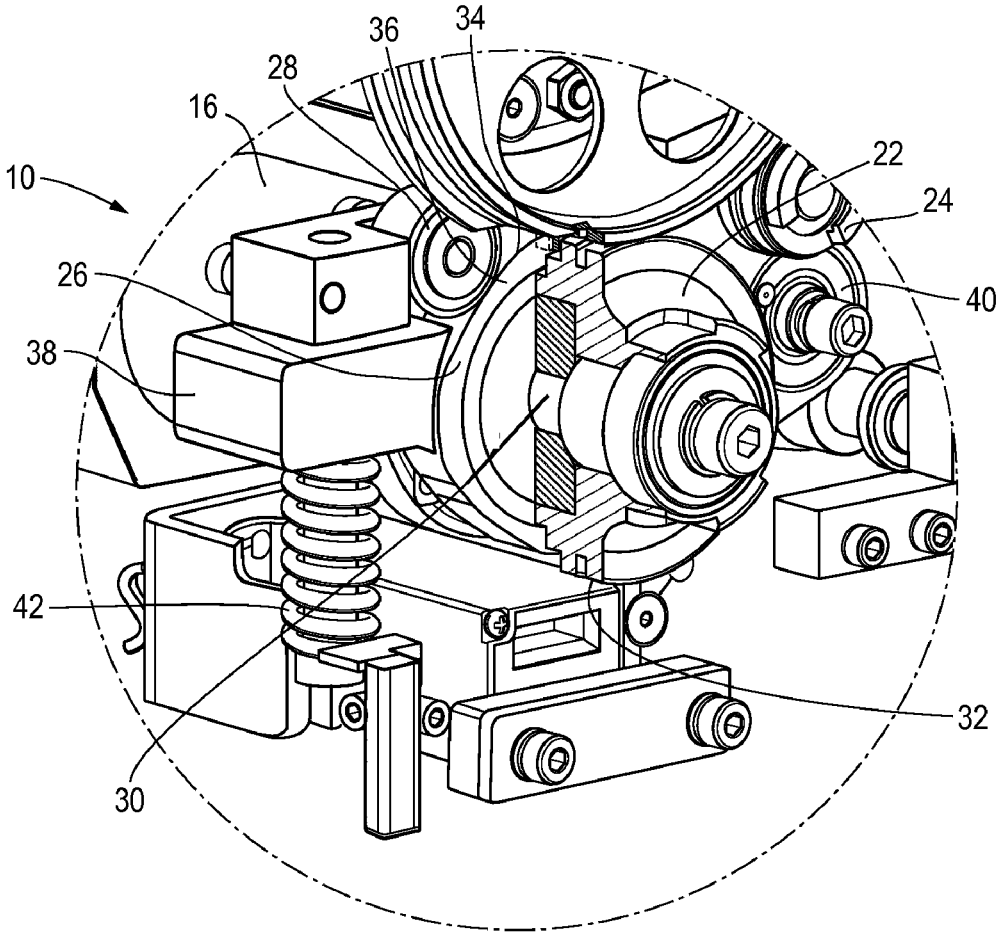
FIG. 3 is an enlarged, partial perspective view of the feed head with a portion of the tension wheel broken away for ease of illustration and explanation.
Figure 4:
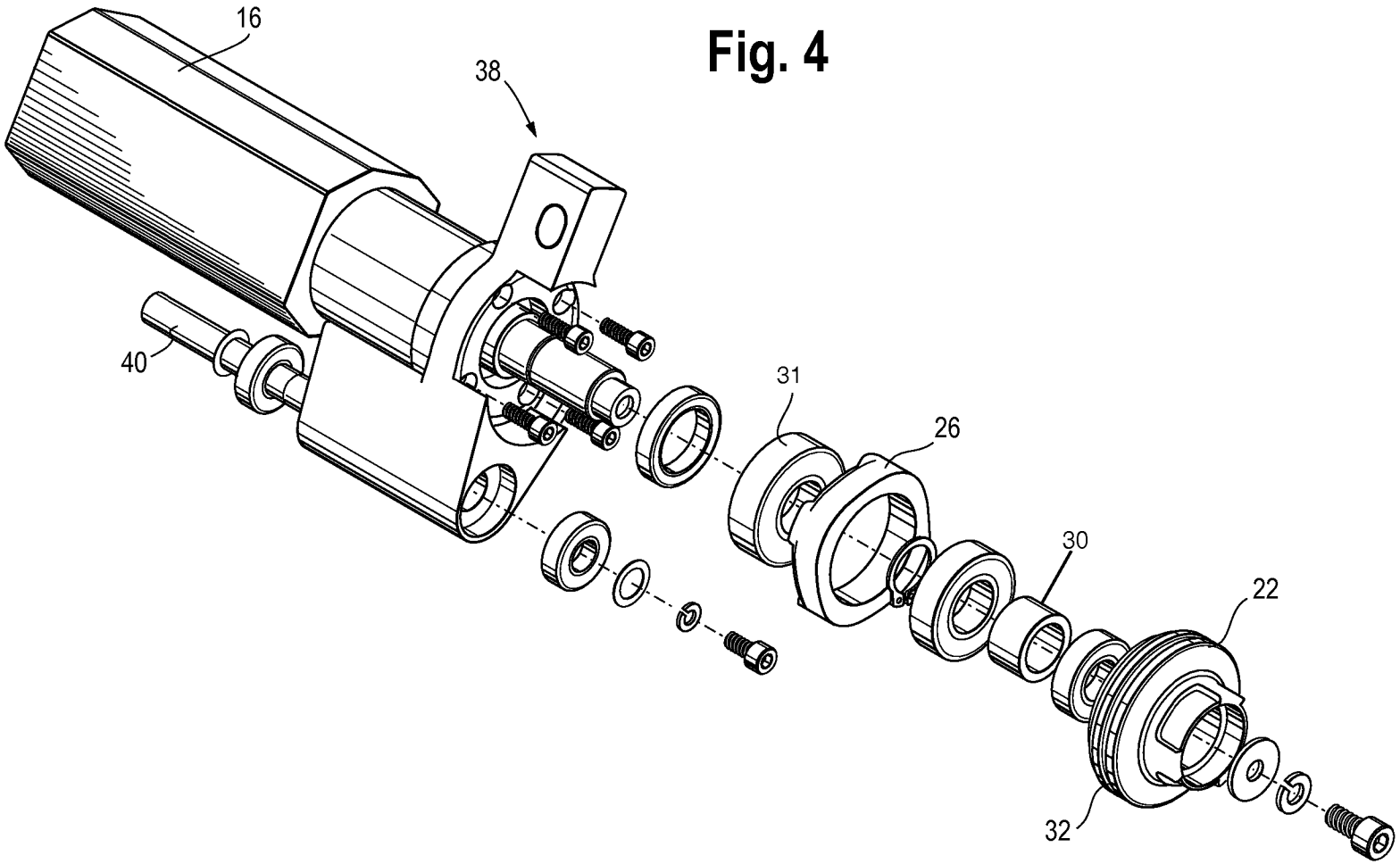
FIG. 4 is an exploded view of the tension motor and tension wheel.
Figure 5:
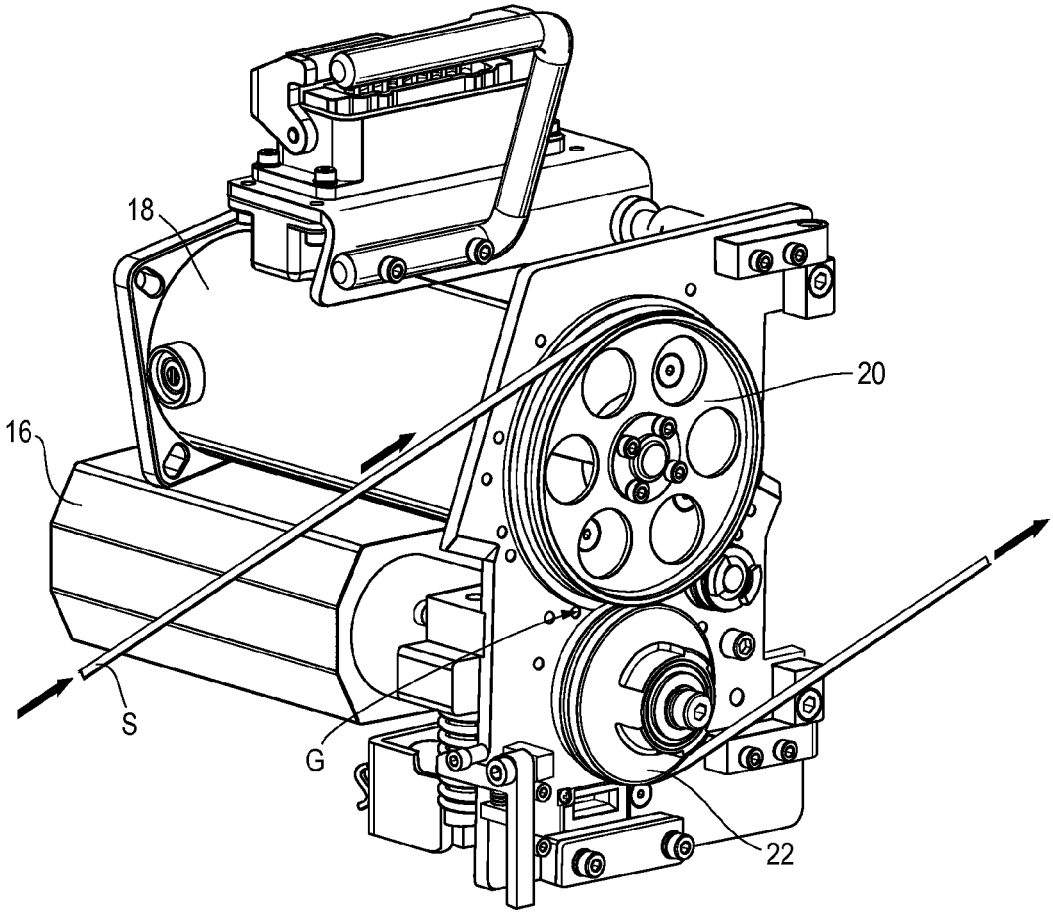
FIG. 5 is a simplified perspective view illustrating the path of the strap material through the feed head.

Referring now to the figures and in particular to FIGS. 2-4, the improved feed head 10 for a strapping machine 12 includes a modular frame 14 on which two motors are mounted. The motors are a tension motor 16 and a high speed, feed and take-up motor 18. The tension motor 16 is configured to operate in a reverse or tension direction. The feed and take-up motor 18 is configured to operate in a forward or feed direction and in the reverse or take-up direction. It will be appreciated that in the forward or feed direction, strap S is fed into the strapping machine 12, toward the load L, and in the take up or tension direction, the strap S is pulled onto and around the load L and subsequently tensioned onto the load L. It will also be appreciated that the modular feed head 10 is readily removed and installed as a single or modular unit onto the strapping machine 12. An example of one such modular configuration is disclosed in Flaum et al., U.S. Pat. No. 6,584,892, which patent is commonly assigned with the present application and is incorporated herein by reference.

The feed head 10 includes a feed wheel 20 operably coupled to the feed and take-up motor 18. A tension wheel 22 is operably coupled to the tension motor 16. A pinch wheel 24 is operably associated with the feed wheel 20. A tension wheel cam 26, and cam follower 28 are operably connected to the tension wheel 22 as is discussed in more detail below.

The tension wheel 22 is mounted to the tension motor 16 by a one-way bearing 30 that drives the tension wheel 22 to rotate in the reverse direction but permits free rotation (is free running) in the forward or feed direction. The tension wheel 22 can be formed with teeth 32 or other frictional surface to enhance engagement of the wheel 22 with the strap S in the tension cycle.

The cam 26 is mounted to a second one-way bearing 31. The cam 26 has high spots (e.g., peaks 34) and low spots (e.g., valleys 36). The cam 26 is configured and disposed to cooperate with the cam follower 28. The cam follower 28 is mounted to the feed head frame 14. The cam follower 28 can be a wheel or like element that permits smooth engagement of the cam 26 and follower 28.

The tension motor 16, tension wheel 22, one-way bearings 30, 31 and cam 26 are mounted to the frame 14 by a carriage 38. The carriage 38 is configured to pivot about the frame 14 on a pivot pin or stud 40. The pivoting movement of the carriage 38 permits the tension wheel 22 to move toward and away from the feed wheel 20 to engage and disengage the tension wheel 22 with the feed wheel 20. When engaged, strap S is pinched between the wheels 20, 22. When disengaged, a gap G is established between the tension and feed wheels 20, 22 the function of which is described below.

The carriage 38 is biasedly mounted to the frame 14 by a spring 42. The spring 42 biases the carriage 38, and thus the tension wheel 22 toward and into contact with the feed wheel 20. The gap G is established by the cam 26 riding on the cam follower 28, when the cam peaks 34 are nearing or on the cam follower 28. In this manner, the tension wheel 22 (carriage 38) is urged away from the feed wheel 20, against the spring 42 bias.

Conversely, when the cam valleys 36 are on the cam follower 28, the gap G is eliminated by the spring 42 force urging the tension wheel 22 (carriage 38) toward and into contact with the feed wheel 20. It will be appreciated that when the gap G is established, the feed and tension wheels 20, 22 are spaced from one another and do not convey the strap S. Conversely, when the gap G is eliminated, the wheels 20, 22 are engaged with one another and, when there is strap S between the wheels 20, 22 and the wheels 20, 22 are driven, the strap S is pinched between the wheels 20, 22 and will be conveyed (in the feed or take-up/tension directions).

Operation of the strapping machine 12 and the feed head 10 will be described in reference to three basic cycles: (1) a feed cycle, in which strap is fed from a supply or dispenser, through the feed and sealing heads, through the strap chute, and back to the sealing head; (2) a take-up cycle, in which the strap is pulled from the chute on to the load; and (3) a tension cycle, in which the strap is tensioned around the load. These cycles are described in more detail below.

In the feed cycle, strap S is fed in the feed direction, from the dispenser 44 into the feed head 10 as shown in FIG. 4. The strap S traverses around the feed wheel 20, through a nip defined between the feed wheel 20 and the pinch wheel 24, and through the gap G defined between the feed wheel 20 and the tension wheel 22. The strap S then continues around the tension wheel 22 and out toward the sealing head 46 and strap chute 48. The strap S is then fed toward and around the load L, and the lead end of the strap S is received by the sealing head 46 and gripped.

In the feed cycle, the feed wheel 20 (via the feed motor 18) is driven in the forward direction to convey the strap S forward. The one-way bearing 30 is free running in the forward direction. As such, as the tension motor 16 begins to rotate in the forward direction, it will rotate slightly. As the tension motor 16 begins to rotate, it engages one-way bearing 31 mounted to the cam 26 which also begins to rotate in the forward direction. As the cam 26 rotates slightly, a peak 34 on the cam 26 engages the cam follower 28 which, against the spring 42 bias, moves the carriage 38 and tension wheel 22 away from the feed wheel 20. The motor 16 is stopped with one of the peaks 34 engaging the follower 28, thus establishing the gap G between feed and tension wheels 20, 22. In this manner, the strap S is free of the tension wheel 22 during feed.

Following the feed cycle, that is, after the strap S has been fed around the chute 48 and the feed end of the strap S has returned to the sealing head 46 and has been gripped in the sealing head 46, the strapping machine 12 enters the take-up cycle. In the take-up cycle, the strap S is pulled from the strap chute 48 onto the load L, and slack in the strap S is taken up within the strapping machine 12 (e.g., strap is pulled back into, for example, a slack box (not shown)). During the take-up cycle, the feed motor 18 and feed wheel 20 reverse to carry out the strap S take-up. With the tension motor 16 stopped (as noted above) with one of the peaks 34 engaging the follower 28, the gap G is maintained between feed and tension wheels 20, 22. Continued rotation of the feed wheel 20 in the reverse direction effects pulling the strap S onto the load L and strap S slack take-up. As the strap S begins to tension on the load L (although still in the take-up cycle), the feed wheel 20 begins to stall which is sensed by non-rotation of the pinch wheel.

Following take-up and sensing of the stalling of the feed wheel 20, the strapping machine 12 cycles into the tension cycle. In the tension cycle, the tension motor 16 first operates in the forward direction. As such, the cam peak 34 rotates off of the cam follower 28 and the spring 42 returns the carriage 38 to the position in which the tension wheel 22 engages the feed wheel 20, closing the gap G between the feed and tension wheels 20, 22 and pinching the strap S between the wheels 20, 22. The tension motor 16 is then reversed, and rotation of tension wheel 22 tensions the strap S around the load L. The tension motor 16, which can include a planetary gear assembly (not shown) develops a relatively high torque, which in combination with the enhanced friction surface, e.g., teeth 32 on the tension wheel 22 can permit, for example, in excess of 250 ft-lbs. of force to tension the strap S.

Once the tension wheel 22 stalls, the sealing cycle continues during which the strap S is sealed onto itself (at the sealing head 46) and the looped strap (around the load L) is severed from the strap feed. The strapping machine 12 can then enter a subsequent strapping cycle (e.g., feed cycle), for a subsequent load.

The advantages of the present feed head 10 will be appreciated by those skilled in the art. The use of only two motors 16, 18 to feed, take up, and tension strap S, as well as to drive the feed and tension wheels 20, 22, reduces and simplifies the number of components in the feed head 10, reducing required machine 12 maintenance. The use of a spring 42 biased carriage 38 for the tension motor 16 and wheel 22, in combination with a cam 26 and one-way bearing 30, eliminates the need for a separate drive component to separate the feed and tension wheels 20, 22 during the tension cycle. In addition, the modular nature of the feed head 10 permits readily removing and replacing the head 10 as a singular component, reducing the downtime and labor required for maintenance or replacement of the head 10.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A modular feed head for a strapping machine of the type for feeding a strapping material around a load, tensioning the strapping material, and sealing the strapping material around the load, the modular feed head comprising:

a frame;

a feed wheel;

a pinch wheel disposed for engagement with the feed wheel;

a tension wheel;

a feed and take-up motor mounted to the frame and operably connected to the feed wheel, the feed and take-up motor configured to operate in a forward direction and a reverse direction, the feed and take-up motor operating in the forward direction driving the feed wheel in the forward direction to feed the strapping material through the strapping machine, and operating in the reverse direction to take up strapping material from the strapping machine;

a tension motor operably connected to the tension wheel, the tension motor operating in the reverse direction to tension the strapping material around the load, the tension wheel movable toward and away from the feed wheel, the tension wheel configured for engagement with the feed wheel during strap tension and disengagement from the feed wheel during strap feed;

a pivot assembly is configured to pivot about the frame, the pivot assembly includes the tension motor and the tension wheel, and a pivoting movement of the pivot assembly permits the tension wheel to move biasedly toward the feed wheel to engage the tension wheel with the feed wheel and to move away from the feed wheel to disengage the tension wheel with the feed wheel; and a cam operably connected to the tension motor, the cam having a lobe, and a cam follower operably mounted to the frame, wherein engagement of the lobe with the cam follower moves the tension wheel away from the feed wheel and disengagement of the lobe with the cam follower allows the tension wheel to move into engagement with the feed wheel.

2. The feed head of claim 1, wherein the pivot assembly includes a carriage, the tension motor and tension wheel being mounted to the carriage.

3. The feed head of claim 2, wherein the carriage is biasedly mounted to the frame.

4. The feed head of claim 3, which includes a spring for biasedly mounting the carriage to the frame.

5. The feed head of claim 4, wherein the spring biases the tension wheel toward the feed wheel.

6. The feed head of claim 5, which includes a one-way bearing operably mounted to the tension motor and tension wheel, the one-way bearing driving rotation of the tension wheel in the reverse direction and permitting rotation of the tension wheel in the forward direction.

7. The feed head of claim 1, wherein the tension wheel includes a friction enhanced surface.

8. The feed head of claim 7, wherein the friction enhanced surface includes teeth formed on a surface of the tension wheel.

9. A strapping machine of the type for feeding a strapping material around a load, tensioning the strapping material, and sealing the strapping material around the load, the strapping machine comprising:

a machine frame;

a strap chute;

a sealing head; and a feed head, the feed head including a frame, a feed wheel, a pinch wheel disposed for engagement with the feed wheel, a tension wheel, a feed and take-up motor mounted to the frame and operably connected to the feed wheel, the feed and take-up motor configured to operate in a forward direction and a reverse direction, the feed and take-up motor operating in the forward direction driving the feed wheel in the forward direction to feed the strapping material through the strapping machine, and operating in the reverse direction to take up strapping material from the strapping machine, a tension motor operably connected to the tension wheel, the tension motor operating in the reverse direction to tension the strapping material around the load, the tension wheel movable toward and away from the feed wheel, the tension wheel configured for engagement with the feed wheel during strap tension and disengagement from the feed wheel during strap feed, a pivot assembly is configured to pivot about the frame, the pivot assembly includes the tension motor and the tension wheel, and a pivoting movement of the pivot assembly permits the tension wheel to move biasedly toward the feed wheel to engage the tension wheel with the feed wheel and to move away from the feed wheel to disengage the tension wheel with the feed wheel, and a cam operably connected to the tension motor, the cam having a lobe, and a cam follower operably mounted to the frame, wherein engagement of the lobe with the cam follower moves the tension wheel away from the feed wheel and disengagement of the lobe with the cam follower allows the tension wheel to move into engagement with the feed wheel.

10. The strapping machine of claim 9, wherein the pivot assembly includes a carriage, the tension motor and tension wheel being mounted to the carriage.

11. The strapping machine of claim 10, wherein the carriage is biasedly mounted to the frame.

12. The strapping machine of claim 11, which includes a spring for biasedly mounting the carriage to the frame.

13. The strapping machine of claim 12, wherein the spring biases the tension wheel toward the feed wheel.

14. The strapping machine of claim 13, which includes a one-way bearing operably mounted to the tension motor and tension wheel, the one-way bearing driving rotation of the tension wheel in the reverse direction and permitting rotation of the tension wheel in the forward direction.

15. The strapping machine of claim 9, wherein the tension wheel includes a friction enhanced surface.

16. The strapping machine of claim 15, wherein the friction enhanced surface includes teeth formed on a surface of the tension wheel.

* * * * *